United States Patent [19]

Tsuboi

[11] 4,076,537

[45] Feb. 28, 1978

[54] LIGHT-SENSITIVE MATERIALS CONTAINING ORGANO TELLURIUM OR SELENIUM COMPOUNDS AND SENSITIZERS

[75] Inventor: Masayoshi Tsuboi, Asaka, Japan

[73] Assignee: Fuji Photo Film Co., Ltd., Minami-ashigara, Japan

[21] Appl. No.: 646,109

[22] Filed: Jan. 2, 1976

[51] Int. Cl.[2] ..... G03C 1/00; G03C 1/52; G03C 1/64

[52] U.S. Cl. ..... 96/88; 96/90 R; 96/91 R; 96/92; 96/75; 96/67; 96/48 HD; 96/49

[58] Field of Search ..... 96/88, 48 HD, 1.5, 49, 96/90 R, 75, 67, 91 R, 92

[56] References Cited

U.S. PATENT DOCUMENTS

| | | | |
|---|---|---|---|
| 1,602,589 | 10/1926 | Sheppard et al. | 96/88 |
| 3,147,117 | 9/1964 | Wainer et al. | 96/90 R |
| 3,634,336 | 1/1972 | Perez-Albuerne | 96/88 |
| 3,684,509 | 8/1972 | Heuvel et al. | 96/88 |
| 3,700,448 | 10/1972 | Hillson et al. | 96/48 R |
| 3,819,377 | 6/1974 | Klose et al. | 96/48 R |

OTHER PUBLICATIONS

Boudreaux, J. Amer. Chem. Soc., vol. 85, No. 14 (1963) pp. 2039–2043.

*Primary Examiner*—Won H. Louie, Jr.
*Attorney, Agent, or Firm*—Sughrue, Rothwell, Mion, Zinn and Macpeak

[57] ABSTRACT

A light-sensitive material comprising a layer containing:

(a) at least one organic compound containing tellurium and/or selenium; and (b) at least one sensitizing compound selected from the oxides, basic halides, halides, sulfates, nitrates, perchlorates, or organic acid salts of In (III), Sb (III), Ti (IV), Zn (II), Bi (III), Ge (IV), and Sn (IV).

15 Claims, No Drawings

LIGHT-SENSITIVE MATERIALS CONTAINING ORGANO TELLURIUM OR SELENIUM COMPOUNDS AND SENSITIZERS

BACKGROUND OF THE INVENTION

1. Field of the Invention

The present invention relates to a light-sensitive material. More particularly, the present invention is concerned with a sensitized light-sensitive material containing at least one organic compound which contains tellurium or selenium.

2. Description of the Prior Art

Although silver halide light-sensitive materials are preferred photographic materials due to their high sensitivity, these materials suffer from the drawbacks that complicated liquid treatments are required for the formation of photographic images after image-wise exposure, which require skill of a high degree and long periods of time, and these materials are high priced since silver is used as a starting material.

Light-sensitive materials per se for use in diazo photography (in which diazonium compounds are used) are cheap as compared to silver halide light-sensitive materials. With diazo light-sensitive materials, however, developing processing using an alkali bath is generally required. Even in the case of thermal diazo photography (dry system) where solution treatments as described are not required, alkali generating agents must be incorporated in the light-sensitive materials. In the case of the Kalvar process in which diazonium compounds are used, a colored image cannot be obtained even if dry processing systems are used, and thus only photographic films for projection are obtained.

With photographic light-sensitive materials using light-sensitive polymers, a liquid treatment is necessary, and, furthermore, as in the case of the above Kalvar process, a colored image cannot be obtained.

Moreover, in the case of free radical photography, dry processings are usually used. However, disadvantages are sublimation, toxicity and low stability of the starting materials, and, furthermore, the images formed are often unstable due to difficulty in fixing the images.

Certain light-sensitive materials have considerably improved these defects of conventional photographic light-sensitive materials, for example, those light-sensitive materials wherein metal salts of organic acids such as behenic acid salts are used as image-forming materials in combination, with silver halide as a light catalyst and a reducing agent. Such materials are marketed under the tradename "Dry Silver", and can be produced by the techniques as described in Japanese Patent Publications 2096/1963, 4921/1968 and 4924/1949.

Such light-sensitive materials, however, are expensive due to the use of silver as an image-forming material. Furthermore, their storage stability prior to use is often poor, and it is necessary to use toxic silver compounds to prevent the formation of fog at thermal development.

In place of the above light-sensitive materials, an image-forming method in which tellurium or selenium-containing organic compounds are used is described in Japanese Patent application (OPI) 29438/1973, Japanese Patent Application 14330/1974, etc. In such a method, an organic compound containing tellurium, or selenium, in some cases in contact with a light sensitizing agent, and a binder are coated on a support. On exposure of the member so produced to light followed by development by heating, an image is formed due to the contrast of the tellurium or selenium.

With such light-sensitive materials, photographic sensitivity can be increased to a certain extend by adding a light sensitizing agent. Up to now, however, sufficient sensitivity has not been obtained, and thus more effective sensitizing techniques have been desired.

SUMMARY OF THE INVENTION

One object of the present invention is to provide a light-sensitive material comprising a light-sensitive layer composed of at least one organic compound containing tellurium or selenium.

Another object of the present invention is to provide a technique of sensitizing the above light-sensitive material.

A further object of the present invention is to provide the above light-sensitive material with improved sensitivity by incorporating therein a sensitizing compound.

These objects are attained by providing a layer comprising:

(a) at least one organic compound containing tellurium and/or selenium; and (b) at least one sensitizing compound selected from the group consisting of the oxides, basic halides, halides, sulfates, nitrates, perchlorates, and organic acid salts of In (III), Sb (III), Ti (IV), Zn (II), Bi (III), Ge (IV), and Sn (IV).

Even to the inventor, who has been involved in research in this field for a long time, it was astonishing that the incorporation of the above sensitizing compounds increased the sensitivity of a light-sensitive material carrying a light-sensitive layer composed of an organic compound containing tellurium and/or selenium.

DESCRIPTION OF PREFERRED EMBODIMENTS

Tellurium and/or selenium-containing organic compounds as used herein include the following compounds.

(1) Elemental organic compounds as described in Japanese Patent Application (OPI) 29438/1973, that is, those compounds in which tellurium or selenium is connected, directly or through a hetero atom other than carbon, preferably N or O, to a carbon atom constituting a part of an organic group (as hereinafter disclosed) through a chemical bond, and which are capable of liberating Te and/or Se on exposure and heating. Their composition may be expressed by the general formula $$R_x—E—X_y \qquad (C)$$

wherein E is an atom of element E as set out above, R is an organic group having a carbon atom directly linked to E, X is an inorganic radical and $x$ is an integer of at least 1 and $y$ is zero or an integer of at least 1 and $x + y$ is an integer usually equal to E, though sometimes smaller than, the valency of E. Where there is a plurality of R substituents at least one of the R substituents, at least one of the R substituents is linked to E by a direct carbon to E-bond while one or more, but not all, of the R substituents may be linked to E over hetero atoms or hetero groups as will be set out hereinafter.

The elemento-organic compound may be in monomeric form as indicated in the above stated general formula (C) or it may be, by covalent bonding or by chemical bonding in form of a dimer or polymer as is well known in the art of elemento-organic compounds. Dimeric or polymeric compounds may comprise a backbone of two or more atoms of the element E linked together and framed by R radicals or by R and X radicals, or the dimeric or polymeric molecule may be formed by conventional organic condensation or addition polymerization by help of suitable reactive groups linked to R or X. As has been mentioned above, E may also stand for two or more different atoms of the elements of the above mentioned groups.

R may be aliphatic, cycloaliphatic or aromatic or a combination thereof and may contain one or more hetero atoms in the chain or rings. It may be unsubstituted or substituted by an suitable organic or inorganic radical which assists in or at least does not interfere with the desired imaging effect.

X may be any desired inorganic radical compatible with the imaging material. The inorganic substituents represented by X may or may not partake in the chemical reaction leading to the imaging. X may be unsubstituted or it may be substituted, especially also by organic radicals. In the substituents of R and/or X may be contained any desired element of the Periodic Table, provided it is compatible with the elemento-organic compound and does not interfere with the imaging quality of the imaging material.

The possible number of atoms of element E and the variety of possible organic and inorganic radicals linked thereto provide great freedom in designing the structure and thus the imaging qualities of the elemento-organic imaging material used in the method of the invention. By the choice of molecular weight, substitution and number of organic radicals it is readily possible to tailor make a compound having a given atom of element E so that it fits perfectly the requirements of a given imaging or information recording task. By varying the length and nature and/or the number of the organic radicals the reactivity and thus the sensitivity of the compound to the energy for imaging, may be readily adjusted to the needs of a given situation. The same applies to the nature and number of inorganic radicals linked to the atom of element E. The choice of R radicals, apart from the radical or radicals directly linked to the atom of element E, becomes even greater by the employment of organic radicals which are linked over an —O—, —N—, —S—, —P— or —As— bridge to the atom of element E.

For instance, those represented by the formulae (I) to (III):

$$Ar—COOH_2— \quad (I)$$

$$Ar—CH_2— \quad (II)$$

$$R—COOH_2— \quad (III)$$

In Formula (I) and (II), Ar indicates an aryl group, which term includes unsubstituted and substituted aryl groups. Preferred aryl groups are those which are unsubstituted or substituted and which have 6 to 26 carbon atoms and 1 to 3 aromatic rings. Preferred unsubstituted aryl groups include phenyl, naphthyl, anthryl, and like groups, and preferred substituted aryl groups include those in which the above aryl groups are substituted by halogen, nitro, hydroxy, cyano, amino, N,N-dimethylamino, alkyl, e.g., methyl, alkoxy, e.g., methoxy, acyl, e.g., acetyl and the like. Of the above, substituents, preferred alkyl groups have 1 to 12 carbon atoms, most preferably 1 to 4 carbon atoms, such as methyl, ethyl, isopropyl, butyl, and the like, preferred alkoxy groups have 1 to 12 carbon atoms, most preferably 1 to 4 carbon atoms, such as methoxy, ethoxy, propoxy, and the like, and preferred acyl groups have 1 to 4 carbon atoms, such as acetyl, propenyl, butylyl, and the like.

On the other hand, in Formula (III), R indicates an alkyl group and an aliphatic hydrocarbon group containing a carbonyl group. More preferred are alkyl groups which have 1 to 12 carbon atoms, and most preferred are those alkyl groups having 1 to 4 carbon atoms such as methyl, ethyl, propyl, etc. More preferred carbonyl-containing aliphatic hydrocarbon groups have 1 to 6 carbon atoms and most preferred are acylalkyl groups having 2 to 4 carbon atoms. The location of the carbonyl group is not overly important so long as the carbonyl group is not directly bonded with tellerium or selenium. The alkyl group includes methyl, ethyl, and the like, and the carbonyl group-containing aliphatic hydrocarbon group includes acylalkyls such as acetylmethyl.

Examples of preferred organic groups represented by Formula (I) are:

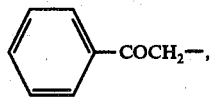

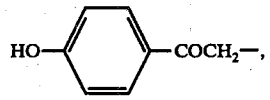

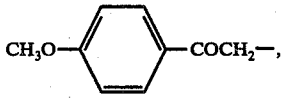

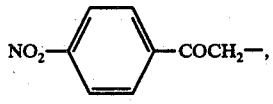

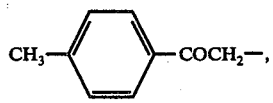

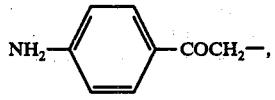

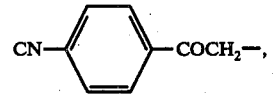

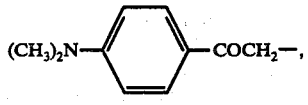

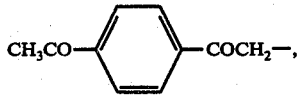

-continued

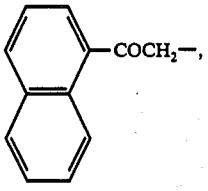

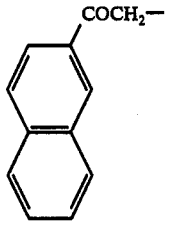

and

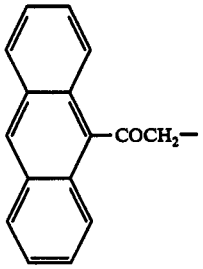

Examples of preferred organic groups represented by Formula (II) are:

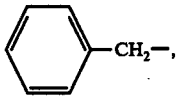

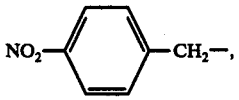

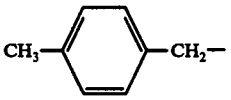

and

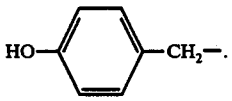

Examples of preferred organic groups represented by Formula (III) are $CH_3COCH_2$—, $C_2H_5COCH_2$—, $CH_3COCH_2COCH_2$—, etc.

(2) Tellurium or selenium complexes composed of (a) tellurium halide or selenium halide, and (b) an organic salt group as described in U.S. patent application Ser. No. 546,976 filed Feb. 4, 1975 and corresponding to British Pat. Application No. 4807/1975.

The above tellurium halides or selenium halides include those compounds represented by the following formula:

$MX_nY_m$ wherein M is tellurium or selenium, X and Y are halogen, $n$ and $m$ are O or integers, and $n+m$ is 2 or 4 depending on the valency of M.

Representative examples of these compounds are tellurium dichloride, tellurium dibromide, tellurium tetrafluoride, tellurium tetrachloride, tellurium tetrabromide, tellurium tetraiodide, selenium tetrachloride, selenium tetrabromide, selenium tetraiodide and the like. From these compounds, one or more compounds can be selected for use.

On the other hand, organic salt groups include basic organic groups such as aliphatic amine compounds, preferably having from 6 to 21 carbon atoms, more preferably from 10 to 21 carbon atoms, aromatic amine compounds where the aromatic moiety preferably has from 6 to 21 carbon atoms, nitrogen atom-containing heterocyclic compounds preferably comprising a total of from 4 to 30 carbon atoms, and the like. For example, those compounds represented by Formulae (I) to (X) can be used.

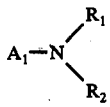

(I)

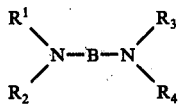

(II)

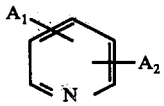

(III)

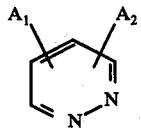

(IV)

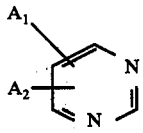

(V)

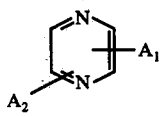

(VI)

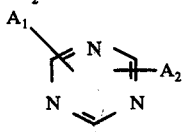

(VII)

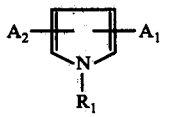

(VIII)

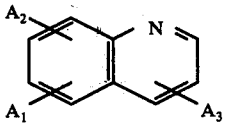

(IX)

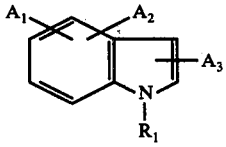

(X)

In the above formulae, $A_1$, $A_2$, and $A_3$ are hydrogen, alkyl(straight, branched or cyclic) and such includes substituted alkyls or aryl such as phenyl, naphthyl, anthryl, etc. (including substituted aryls).

Alkyl groups containing 1 to 25 carbon atoms are most useful, and illustrative substituents therefore are alkoxy, aryl, aryloxy, aminoalkyl, aminoaryl, sulfonylalkyl, sulfonylaryl, halogenoalkyl, aralkyl and the like; preferred substituents are those wherein any alkyl moiety, for example, in alkoxy, contains from 6 to 21 carbon atoms, preferably from 10 to 21 carbon atoms, and wherein any aryl moiety, for example, in aminoaryl, contains from 6 to 21 carbon atoms.

Aryl groups for $A_1$, $A_2$ and $A_3$ include phenyl, naphthyl, anthryl, phenanthryl, and the like, and illustrative substituents therefor are alkyl, aryl, alkoxy, aryloxy, acetyl, sulfonylalkyl, sulfonyaryl, halogenoalkyl, halogenoaryl, aralkyl, and the like. Preferred substituents are those wherein any alkyl moiety, for example, in alkoxy, contains from 6 to 21 carbon atoms, preferably from 10 to 21 carbon atoms, and wherein any aryl moiety, for example, in aminoaryl, contains from 6 to 21 carbon atoms.

Specific examples of groups represented by $A_1$, $A_2$, and $A_3$ include methyl, ethyl, propyl, isopropyl, cyclopropyl, butyl, sec-butyl, tert-butyl, pentyl, isopentyl, neopentyl, tert-pentyl, hexyl, isohexyl, tert-hexyl, cyclohexyl, heptanyl, isoheptanyl, tert-heptanyl, methylcyclohexyl, octyl, isooctyl, tert-octyl, dimethylcyclohexyl, nonyl, tert-nonyl, decyl, tert-decyl, dimethylcyclohexyl, undecyl, tert-undecyl, dodecyl, tert-dodecyl, tridecyl, tert-tridecyl, tetradecyl, tert-tetradecyl, pentadecyl, sec-pentadecyl, tert-pentadecyl, hexadecyl, octadecyl, sec-octadecyl, tert-octadecyl, nonadecyl, sec-nonadecyl, tert-nonadecyl, eicosyl, sec-eicosyl, tert-eicosyl, heneicosyl, sec-heneicosyl, tert-heneicosyl, docosyl, sec-docosyl, tert-docosyl, tricosyl, sec-tricosyl, tert-tricosyl, tetracosyl, sec-tetracosyl, tert-tetracosyl, pentacosyl, sec-pentacosyl, tert-pentacosyl, ethoxyethyl, ethoxypropyl, ethoxybutyl, ethoxypentyl, ethoxyhexyl, methoxyhexyl, methoxybutyl, ethoxyheptyl, methoxyoctyl, ethoxyoctyl, benzyl, triphenylmethyl, phenyl, naphtyl, tolyl, xylyl, mesityl, oxyphenyl, dioxyphenyl, acetylphenyl, benzophenyl, methoxyphenyl, ethoxyphenyl, nitrophenyl, dinitrophenyl, chlorophenyl, bromophenyl, trifluoromethylphenyl, biphenyl, phenoxyphenyl, vinylphenyl, sulfonylphenyl, naphthyl, acetonaphthyl, chloronaphthyl, dichloronaphthyl, oxynaphthyl, methylnaphthyl, methoxynaphthyl, ethoxynaphthyl, anthryl, acetoanthryl, chloroanthryl, oxyanthryl, dioxyanthryl, methoxynaphthyl, phenanthryl, acetylphenanthryl, methoxyphenanthryl, dimethoxyphenanthryl, fluonyphenanthryl and the like.

Preferred groups represented by $A_1$, $A_2$, and $A_3$ are hydrogen atoms; alkyl groups with 2 to 25 carbon atoms (which may be substituted with a methoxy or ethoxy group or with a phenyl group; phenyl groups which may be substituted with a methyl, ethyl, methoxy, ethoxy, acetyl, trifluoromethyl, nitro, hydroxyl, acetophenonyl, phenoxy or phenyl group or a halogen atom), naphthyl groups, anthryl (anthracenyl) groups and phenanthryl groups.

In the above formulae, B is a divalent or higher aliphatic hydrocarbon group (straight or branched, and such term includes substituted divalent or higher aliphatic hydrocarbon groups, and furthermore includes those divalent or higher aliphatic hydrocarbon group with substituted or unsubstituted phenylene or double bonds incorporated in their straight chains) or an arylene group as above described for $A_1$, $A_2$ and $A_3$ (which term includes substituted arylene groups as above described for $A_1$, $A_2$ and $A_3$). Most preferably, B has a valency no greater than 4.

Useful divalent or higher aliphatic hydrocarbon groups contain 1 to 10 carbon atoms. Substituents therefore include alkoxy, aryl, aryloxy, nitro, amino, aminoaryl, arylalkyl, acetyl, halogen, etc. Most preferred substituents are those alkoxy groups having from 1 to 4 carbon atoms and then aryl groups (such as $\alpha$ a phenyl or naphthyl group), aryloxy group such as phenoxy or naphthoxy, optionally substituted by a methyl or ethyl group, aminoaryl groups such as aminophenyl or aminonaphthyl, optionally substituted by one or more alkyl groups having 1 to 4 carbonatoms, and arylalkyl groups such as phenyl or naphthyl groups substituted by one or more alkyl groups having 1 to 4 carbon atoms. Typical groups incorporated in the straight chain include phenylene, substituted phenylene, most preferably substituted with an alkyl group having 1 to 4 carbon atoms, naphthylene, substituted naphthylene, most preferably substituted with a methyl or ethyl group, biphenylene, substituted biphenylene, most preferably substituted with a methyl or ethyl group, carbonyldiarylene, thiocarbonyldiarylene, involving a diarylene group such as diphenylene or dinaphthylene, e.g.,

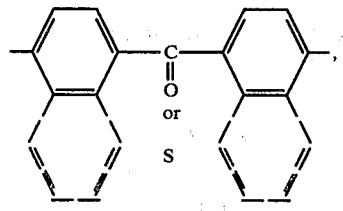

etc.

Useful examples of arylene groups represented by B are phenylene, naphthylene, anthrylene, phenanthrylene, etc., and typical substituents include alkyl, aryl, alkoxy, aryloxy, nitro, amino, aminoaryl, arylalkylene, aralkyl, halogen, acetyl, acetylaryl, and hydroxy; preferred of such substituents are alkyl groups having 1 to 12 carbon atoms, more preferably 1 to 4 carbon atoms, aryl groups such as phenyl, naphthyl, biphenyl, etc., alkoxy groups having 1 to 4 carbon atoms, particularly methoxy and ethoxy, aryloxy groups such as phenoxy and naphthoxy, aminoaryl groups such as aminophenyl or aminonaphthyl, optionally substituted by one or more alkyl groups having 1 to 4 carbon atoms, arylalkylene groups such as a 1 to 4 carbon atom alkylene substituted phenyl or naphthyl group, an aralkyl group such as a phenyl or naphthyl group substituted by one or more alkyl groups having 1 to 4 carbon atoms, and acetylaryl groups such as an acetylphenyl or acetylnaphthyl group.

Example of groups represented by B include ethylene, propylene, butylene, pentamethylene, heptamethylene, octamethylene, nonamethylene, decamethylene, ethylethylene, dimethylpropylene, methylbutylene, dimethylbutylene, ethylbutylene, methylpentamethylene, dimethylpentamethylene, ethylpentamethylene, diethylhexamethylene, phenylpropylene, chlorophenylpropylene, oxypentamethylene, oxyheptamethylene, methoxyheptamethylene, methoxyoctamethylene, ethoxynonamethylene, ethoxydecamethylene, chloropentamethylene, chlorooctamethylene, benzylbutylene, benzylpropylene, tolylbutylene, tolylpentamethylene, xylylbutylene, xylylheptamethylene, 4,4'-methylenediphenylene, 4,4'-phenylmethylenediphenylene, 4,4'-carbonyldiphenylene, 4,4'-aminophenyldiphenylene, oxydiphenylene, propenylene, butenylene, pentenylene, heptenylene, octenylene, nonanylene, decadienylene, nonadienylene, octadienylene, heptadienylene, phenylene, chlorophenylene, aminophenylene, nitrophenylene, methoxyphenylene, phenylphenylene, phenoxyphenylene, aminophenylphenylene, styrylphenylene, acetylphenylene, acetylphenylphenylene, aminophenacylphenylene, bromophenylene, oxyphenylphenylene, biphenylene, methylbiphenylene, dimethylbiphenylene, oxybiphenylene, naphthylene, acetonaphthylene, methylnaphthylene, dimethylnaphthylene, oxynaphthylene, phenanthrylene, acetylphenanthrylene, methylphenanthrylene, methoxyphenanthrylene, and the like.

Particularly useful groups are alkylene containing 2 to 6 carbon atoms, unsubstituted or substituted by phenyl, aminophenyl, halogen, alkyl containing 1 to 2 carbon atoms, or hydroxy; monoene, diene, or triene hydrocarbons containing 2 to 6 carbon atoms, or those in which, 4,4'-methylenediphenylene, 4,4'-carbonyldiphenylene, oxydiphenylene, or diphenylene is present in the straight chain; phenylene or alkyl-(which contains 1 to 2 carbon atoms), alkoxy-(which contains 1 to 2 carbon atoms), acetyl, halogen, trifluoromethyl-, nitro-, hydroxyl-, acetophenyl-, phenoxy-, amino-, aminophenyl-, nitro-, phenyl-, halogenophenyl-, oxyphenyl- or phenyl-substituted phenylene; naphthylene; anthrylene; and phenanthrylene.

$R_1$, $R_2$, $R_3$, and $R_4$ may be the same or different, and can be hydrogen, alkyl or aryl. The alkyl may be either straight, branched or cyclic. Useful alkyls contain 1 to 6 carbon atoms and useful aryls are phenyl or naphthyl. Both the alkyl and aryl may be substituted by alkyl, aminoalkyl, aminoaryl, alkoxy, halogen, or the like; most preferred of such substituents are alkyl groups having 1 to 4 carbon atoms, aminoalkyl groups of the formula $H_2N—C_nH_{2n}—$ where $n = 1$ to 4, aminoaryl groups of the formula

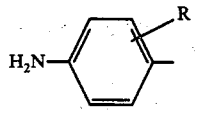

where R = H or $CH_3$, and alkoxy groups having 1 to 4 carbon atoms.

Examples of groups represented by $R_1$, $R_2$, $R_3$ and $R_4$ include methyl, ethyl, propyl, butyl, hexyl, octyl, pentyl, cyclopentyl, cyclohexyl, chloroethyl, phenyl, styryl, p-methoxyphenyl, p-chlorophenyl, p-nitrophenyl, naphthyl, p-aminophenyl, aminonaphthyl, tolyl, hydroxyl and the like.

Particularly useful groups include alkyls containing 1 to 2 carbon atoms which are unsubstituted or substituted by chlorine or phenyl; phenyl, unsubstituted or substituted by alkoxy having 1 to 4 carbon atoms, nitro, or amino; and hydrogen.

Substituents $A_1$, $A_2$, $A_3$, B, $R_1$, $R_2$, $R_3$, and $R_4$ of compounds represented by Formulae (I) to (X) are not limited only to the above described compounds, and these compounds may contain any substituent provided that they can form a complex salt together with a selenium halide or a tellurium halide.

Representative examples of such compounds are ethylamine, propylamine, butylamine, tert-butylamine, pentylamine, isopentylamine, hexylamine, heptanylamine, octylamine, nonylamine, decylamine, tert-decylamine, undecylamine, dodecylamine, tetradecylamine, pentadecylamine, octadecylamine, nonadecylamine, eicosylamine, decosylamine, tricosylamine, tetracosylamine, pentacosylamine, ethoxyethylamine, ethoxypropylamine, ethoxybutylamine, ethoxypentylamine, ethoxyhexylamine, methoxyhexylamine, methoxyoctylamine, methoxyeicosylamine, methoxytricosylamine, benzylamine, triphenylmethylamine, phenethylamine, vanillylamine, veratrylamine, poly(p-aminostyene), N-methylethylamine, N-methylpropylamine, N-methylbutylamine, N-methyl-tert-butylamine, N-methylheptanylamine, N-methyloctylamine, N-methylnonylamine, N-methyl-tert-decylamine, N-methyloctadecylamine, N-methyldecylamine, N-methylethoxybutylamine, N-methylmethoxyhexylamine, N-methylmethoxyeicosylamine, N-methylbenzylamine, N-methyltrimethyamine, N-methylphenethylamine, N-methylvanillylamine, N-methylveratrylamine, N-ethylbutylamine, N-ethylpentylamine, N-ethyldecylamine, N-ethyldodecylamine, N-ethyloctaadecylamine, N-ethyleicosylamine, N-ethyldocosylamine, N-ethyltetracosylamine, N-ethylpentacosylamine, N-ethylethoxyhexylamine, N-ethylmethoxyhexylamine, N-ethylbenzylamine, N,N-dimethylethylamine, N,N-dimethylpropylamine, N,N-dimethylbutylamine, N,N-dimethyl-tert-butylamine, N,N-dimethylheptanylamine, N,N-dimethyloctylamine, N,N-dimethylnonylamine, N,N-dimethylmethoxyhexylamine, N,N-dimethylmethoxyeicosylamine, N,N-dimethylphenethylamine, N,N-dimethylvanillyl, N,N-dimethylveratrylamine, N,N-diethylvanillylamine, N,N-diethylpropylamine, N,N-diethylbenzylamine, N,N-dimethylbenzylamine, aniline, nitroaniline, trifluoromethylaniline, toluidine, ethylaniline, chloroaniline, bromoaniline, methylaminobenzoate, butylaniline, phenylaniline, naphthylaniline, dinitroaniline, naphthylamine, methoxyaniline, acetylaniline, N-methylaniline, N-ethylaniline, N,N-dimethylaniline, N,N-diethylaniline, N-methylnitroaniline, N,N-dimethylnitroaniline, N,N-diethylnitroaniline, N,N-dimethylnitroaniline, N,N-dimethyltoluidine, N,N-dimethylacetylaniline, N,N-dimethylmethoxyaniline, N,N-dimethylnaphthylamine, N,N-dimethyltrifluoroaniline, p-n-dodecylaniline, ethylenediamine, propylenediamine, butylenediamine, ethylethylenediamine, methyltrimethyldiamine, propenyldiamine, hexadienyleneamine, phenyltrimethylenediamine, diaminodiphenylmethane, diaminobenzophenonenaphtylenediamine, benzidine, oxydiphenylenediamine, phenylenediamine, methylphenylenediamine, ethylphenylenediamine, N,N,N',N'-tetramethylphenylenediamine, N,N,N',N'-tetramethyl-oxydiphenylenediamine, tetrabase, N,N,N',N'-tetramethyldiaminobenzophenone, N,N,N',N'-tetramethylbenzidine, N,N,N',N'-tetramethylethylenediamine, N,N,N',N'-tetramethylhexamethylenediamine, N,N,N',N'-tetramethylpropanediamine, N,N,N',N'-tetramethyltrimethylenediamine, pyridinediamine, dimethylpyridine, pyridine carbinol, pyridine ethanol, pyridine-carboxylic acid-methyl ester, pyrazine, methylpyrazine, ethylpyrazine, methyl pyrazinecarboxylate, trimethylpyrazine, pyrimidine, 5-methylpyrimidine, methoxypyrimidine, 5-hydroxypyrimidine, methylpyridazine, methoxypyridazine, phenylpyridazine, ethylpyridazine, triazine, pyrrole, N-methylpyrrole, acetylpyrrole, dinitropyrrole, tetramethylpyrrole, dipyrrylmethane, N-methylacetylpyrrole, indole, α-aminoethylindole, methylindole, methoxyindole, N-methylindole, N-methyl-methylindole, dimethylindole, quinoline, quinoline methanol, chloroquinoline methoxyquinoline, nitroquinoline, aminoquinoline, and the like.

These compounds can be used, as desired, in combination with each other.

Complexes as used herein can be synthesized by reference to A. Lowy and P. F. Dunbrook, *Journal of the American Chemical Society,* 44, 614 (1922), S. Prasad and B. L. Khandelwal, *Journal of the Indian Chemical Society,* 38, 837 (1961), R. Korewa, *Roczniki Chemistry,* 37, 1565 (1963), E. A. Boudreaux, *Journal of the American Chemical Society,* 85, 2039 (1963), etc.

Hereinbelow, preparation examples of typical compounds are shown.

PREPARATION EXAMPLE 1

Complex of Ethylenediamine and Tellurium Tetrachloride: $C_2H_4(NH_2)_2\ TeCl_4$ Into a 200 ml flask equipped with a stirring unit and a dropping unit were placed 6.75 g (0.025 mole) of tellurium tetrachloride and 50 ml of chloroform. A solution of 1.65 g (0.0275 mole) of ethylenediamine in 50 ml of chloroform was added thereto over a three minute period with stirring at room temperature. After the completion of addition, stirring was continued for an additional 1 hour at room temperature. The precipitate obtained was filtered and washed with chloroform until the filtrate did not form any complex with tellurium tetrachloride, and then dried.

Yield 7.8 g (94% yield, pale yellow powder; decomposition at not less than 150° C)

PREPARATION EXAMPLE 2

Complex of p-Nitrobenzenediazonium Chloride and Tellurium Tetrachloride: $(O_2NC_6H_4N_2)_2\ TeCl_6$ A solution of p-nitrobenzenediazonium chloride in ethyl alcohol was produced from p-nitroaniline in anhydrous ethanol by a Koenigs process (Ann, 509, 149 (1934)). The solution so prepared was added to a suspension of tellurium tetrachloride in ethyl alcohol in such a manner that the diazonium salt was present in an amount twofold the moles of tellurium tetrachloride. The resulting mixture was stirred for about 1 hour at room temperature. The precipitate obtained was filtered, washed with ether and dried under reduced pressure. A p-nitrobenzenediazonium chlorotellurium complex, m.p., 121° C, was obtained in quantitative yield. This reaction was conducted in the dark.

A simple test will enable one skilled in the art to determine if an acceptable complex salt is formed or not. For example, an alcohol, anhydride or chloroform solution of the compound to be tested is added to an ethyl alcohol or chloroform suspension of, e.g., tellerium tetrachloride, and the obtained suspension stirred at room temperature and then filtered to obtain a reaction product, followed by washing with ether, drying and measurement of the IR spectrum thereof or, alternatively by dissolution in an appropriate solvent and measurement of the NMR spectrum thereof, to determine if the characteristic absorption due to the formation of a complex salt is shown. A further useful test, and perhaps a simplier one for rough estimation, is that the solubility of a compound to be tested in an organic solvent in the presence of tellerium tetrachloride is lower than in the identical organic solvent free of tellerium tetrachloride.

For example, the following is an illustrative test for p-acetylaniline. 0.02 mol of p-acetylaniline was added to a 240 ml chloroform solution containing 0.01 mol of tellerium tetrachloride and the system thereafter stirred at room temperature for 30 minutes, whereby a light-yellow complex was formed. This complex was subjected to IR spectral analysis and show a broad absorption peak at 3000 $cm^{-1}$ which corresponded to the amine complex. NMR spectral analysis thereof showed a methyl peak at 2.6 ppm, also confirming the formation of the complex.

On the other hand, the sensitizing compounds, which are the most unique components used in light-sensitive materials of the present invention, are the oxides, basic halides, halides, sulfates, nitrates, perchlorates, and organic acid salts of In (III), Sb (III), Ti (IV), Zn (II), Bi (III), Ge (IV), and Sn (IV). The values in the above parentheses indicate the oxidation number.

Preferred organic acid salts are of organic monobasic or dibasic acids optionally substituted with one or more hydroxy groups, most preferably such organic acid having 1 to 21 carbon atoms (in particular, 1 to 6 carbon atoms) and include acids such as formic acid, acetic acid, propionic acid, butyric acid, tartaric acid, citric acid, benzoic acid, maleic acid, malonic acid, etc.

Preferred examples of these sensitizing compounds are $Sb_2O_3$, $Bi_2O_3$, BiOCl, SbOCl, SbOBr, $SbF_3$, $SbCl_3$, $BiF_3$, $BiCl_3$, $Bi(NO_3)_2$, ZnO, $TiO_2$, $In_2O_3$, $InCl_3$, and the like. Of these preferred compounds, those compounds containing Sb or Bi are particularly preferred. Although halides such as $BiBr_3$, $BrI_3$, $SbBr_3$, $SbI_3$, $BnBr_2$, and the like can be used as sensitizing compounds, where halogen-containing tellurium or selenium compounds such as $(C_{14}H_{29}NH_2)_2TeCl_4$, $(CH_3OC_6H_5COCH_2)_2TeCl_2$, and the like are used as the tellurium or selenium-containing compound in combination therewith, they are not prefered in that those sensitizing compounds containing halogen and having an atomic weight higher than the halogen containing tellurium or selenium compounds are apt to desensitize. This is believed to be due to the fact that the halogen of the tellerium or selenium compound exchanges with the halogen of the sensitizer.

Such a sensitizing compound is added in an amount of about 0.5 to about 50 parts by weight, preferably 2 to 20 parts by weight, per 100 parts by weight of the Te or Se image-forming material. Where the amount is excessively small, no sensitizing effect is obtained, whereas if the amount is excesively large, those compounds insoluble in solutions of binders as shown hereinafter, e.g., oxides, sulfates, and the like, deteriorate the transparency of the light-sensitive layer, or where $TiO_2$, ZnO, or the like is added in a large amount, desensitization is caused.

These sensitizing compounds not only increase photographic sensitivity, but sometimes increase image density. This is considered to be due to the fact that the addition of sensitizing inorganic compounds accelerates development. In some cases, these sensitizing compounds blacken the color tone.

With regard to $TiO_2$, both the anatase and rutile forms are effectively used. The anatase type, however, is desired in that its desensitizing tendency is weak.

By further incorporating light sensitizing agents into the light-sensitive layer, or a layer adjacent thereto, of light-sensitive materials of the present invention, their capabilities can be improved. Typical examples of such adjacent layers are a protective layer or an undercoating layer (to increase adherency between the base and light-sensitive layer). Good results are obtained when from about 0.1 to about 100 parts by weight of light sensitizing agent(s) is used per 100 parts by weight of the tellerium or selenium compound(s).

These light sensitizing agents include quinone compounds, aryl ketone compounds, tetracyanoquinodimethane; benzene or naphthalene substituted by hydroxy or alkoxy containing 1 to 7 carbon atoms; arylamine compounds, diazonium salts, metal acetylacetonates, and inorganic metal salts.

Preferred of such materials are quinone compounds such as o-or p-benzoquinones, o-or p-naphthoquinones, phenanthroquinones, anthraquinones, etc., which may be substituted by an alkyl, alkynyl or alkenyl group having 1 to 20, preferably 1 or 6, carbon atoms and an aryl group having 6 to 12 carbon atoms which itself may be substituted by an alkyl group having 1 to 2 carbon atoms, aryl-ketone compounds such as a phenyl, naphthyl, anthryl or phenanthryl group substituted with at least one acyl group having 1 to 4 carbon atoms, aryl-amine compounds such as amines substituted with one or more phenyl or naphthyl groups, wherein the phenyl or naphthyl group may itself be substituted by one or more hydroxy groups, diazonium salts as shown by formula $ArN_2^+X^-$ wherein Ar is an aryl group such as a phenyl or naphthyl group which may be substituted by one or more alkoxy group (having 1 to 4 carbon atoms), alkyl groups (having 1 to 4 carbon atoms), dialkylamino groups (such as alkyls having 1 to 4 carbon atoms), morpholino groups, etc.; and $X^-$ is a halogen ion, $BF_4^-$, $SO_3^{2-}$, etc., metal acetylacetonates as shown by the formula $M(AA)_x$ wherein M is Co, Ni, Cr, Fe, Zr, Mo or an oxide thereof, AA is acetyl acetonate, dibenzylmethan or acetylbenzylmethan, and $x$ is the valency of M (2 or 3) and inorganic metal salts such as salts of Fe, Co, Ni, Zr, Mo with a mono or dibasic-organic acid (having 1 to 4 carbon atom), ferricyanic acid, or a halogen.

Representative examples are 1-nitroanthraquinone, 2-tert-butyl-anthraquinone, chloranil, benzophenone, 3-methylnaphthoquinone, tetrabromoquinone, 9,10-phenanthrenequinone, 2-nitrophenanthrenequinone, 2,5-dinitrophenanthrenequinone, acetophenone, fluorenone, benzil, p-acetylbenzophenone, Michler's ketone, p-diacetylbenzene, ω-tribromo-acetophenone, 2,4,7-trinitrofluoroenone, β-naphthoquinone, p-benzoquinone, α-naphthoquinone, resorcinol, anisole, p-methoxyphenol, 4-methoxy-α-naphthol, diphenylamine, triphenylamine, 4-hydroxydiphenylamine, 4-ethoxybenzene diazonium chloride, 2,5-dimethoxybenzene diazonium chloride, 4-N,N-dimethylaminobenzene diazonium chloride, 1,6-diethoxy-N,N-diethylaminobenzene diazonium chloride, 4-morpholinobenzene diazonium chloride, zirconium acetyl acetonate, molybdenumoxy-acetylacetonate, $FeCl_2$, $FeCl_3$, $FeBr_2$, $FeBr_3$, iron oxalate, ferricyanides, cobaltous acetate, and the like.

Tellurium- or selenium-containing organic compounds and sensitizing compounds are incorporated into a binder in such a manner that they come into contact with each other, and light sensitizing agents may be incorporated either into this layer or into an adjacent layer. In either case, it is preferred that the light sensitizing agent be present in an amount of from about 1 to about 50 parts by weight based on 100 parts by weight of dry binder. While such an adjacent layer can be either over or under the tellerium- or selenium-containing organic compound layer, it is most preferred that such an adjacent layer be over the tellerium- or selenium- containing organic compound layer.

The sensitizing compound can be added to the binder after being dissolved in a solvent miscible with the binder or it is possible to mix the sensitizing compound and the binder, finely pulverize or fuse the same and then add them to a binder solution containing the tellurium or selenium-containing organic compound. Alternatively, the sensitizing compound, tellurium or selenium organic compound, and in some cases, the light sensitizing agent, are added to a solution of this binder.

The highest sensitivity can be obtained by a method in which the tellurium or selenium-containing organic compound and the light sensitizing agent are both dissolved in the binder solution, to which the sensitizing compound as described above is added, and the resulting light-sensitive solution is coated on a support.

Alternatively, a light-sensitive material can be produced as follows: the binder solution of the light sensitizing agent is coated on a support; or the light sensitizing agent is vapor-deposited, most preferably at a thickness of from about 50 to about 2,000 A, on a support without any binder, and the binder solution containing the image-forming material and the sensitizing compound is provided on the vapor-deposited layer; or the binder solution containing the image-forming material and the sensitizing compound is coated on the support and then a binder layer of the light sensitizing agent is provided on the above prepared layer.

The binders and solvents for use in each layer may be either the same or different.

Coating can be carried out using conventional apparatus, e.g., a rod coating machine, a roller coating machine, a curtain coating machine, a dip coating machine, a hopper coating machine, etc.

As binders there can be used a wide variety of synthetic or natural polymers. Suitable binders are those which are stable to light, oxygen, and moisture, durable upon long storage, sufficiently stable to heating at development, easily soluble in a solvent, and capable of forming a film. The molecular weight of the polymers used as binders is preferably from about 1,000 to about 500,000, but this is not limitative.

These polymers include various kinds of vinyl polymers, e.g., polyvinyl chloride, polyvinylidene chloride, a copolymer of vinylidene chloride and acrylonitrile (where the molar ratio of acrylonitrile is not more than 50%), polyvinyl acetate, polyvinyl alcohol, polyvinyl formal, polyvinyl butyral, polystyrene, polymethyl methacrylate, polyvinyl pyrrolidone, and the like, synthetic polymers such as condensation type polymers such as nylon, polyesters, and the like, semi-synthetic polymers such as cellulose acetate, and the like, natural polymers, e.g., gelatin and the like, etc.

Preferred solvents for use in production of a coating solution are generally polar solvents. Those solvents having excessively high or low vapor pressures should not be used in order to easily achieve appropriate drying speeds on an industrial scale, and thus those solvents having a boiling point ranging from about 40° C to about 200° C are preferred. For example, N,N-dimethylformamide, dimethylsulfoxide; aliphatic ketones such as acetone, methyl ethyl ketone, and the like; lower monohydric alcohols such as methanol, ethanol, and the like; cyclic ethers such as tetrahydrofuran, dioxane, and the like; esters such as ethyl acetate, ethylene glycol monoethyl ether, and the like; halogenated hydrocarbons such as chloroform, carbon tetrachloride, methylene chloride, trichloroethylene, and the like; aromatic hydrocarbons such as benzene, toluene, xylene, and the like, and the halides of such aromatic hydrocarbons; etc., can be used.

In the present invention, any support can be used provided that it is able to carry the light-sensitive layer and have good adherence to the binder. The support may be either transparent or opaque, or lustrous. For example, transparent synthetic or semi-synthetic polymers such as polyesters, polyimides, cellulose triacetate, and the like; opaque materials such as paper, synthetic paper, cellulose fiber, synthetic fibers, such as polyethylene, polyamide, etc., leather, wood plates, and the like; polyethylene laminated paper; or inorganic materials such as metal plates, glass plates, and the like can be used. The support is selected depending on the end use of the light-sensitive materials of the present invention. It is preferred that the support be in the form of a thin film (for example, a polymer film such as a polyester, or paper).

It goes without saying that conventional undercoating agents can be used in order to improve adherence between the light-sensitive layer and the support.

The thickness of the support preferably ranges between about 10 $\mu$ and about 300 $\mu$, although such is not limitative, and the support thickness can vary depending on the use of the light-sensitive material of the present invention.

Light-sensitive materials of the present invention do not necessarily include a support. That is, a light-sensitive layer provided on an appropriate support, e.g., a glass plate, a metal plate, etc., can be peeled off the support, and the resulting layer composed of the binder itself used as a light-sensitive material.

The thickness of the light-sensitive layer provided on the support is, when dried, from about 0.5 $\mu$ to about 50 $\mu$, preferably from 1 $\mu$ to 20 $\mu$. The concentration of the binder in the coating solution, and the coating conditions, are controlled so that the above thickness is obtained.

The concentration of the binder generally ranges from about 1% to about 50% by weight of the solvent used, although it varies depending on the kind and molecular weight of the binder.

Drying is preferably carried out at a temperature of not more than 100° C, in particular, from 40° C to 80° C.

The amount of Component (a) can be changed in a wide range depending on the use of the light-sensitive material the desired sensitivity, and the like. However, it is preferred that it be used in an amount of not more than about 60% by weight based on the weight of the binder so that light-sensitive layers which are highly stable, i.e., free from crazing and loss of clarity, are obtained. Further, it is most preferred that Component (a) be used in an amount of at least about 30% by weight based on the weight of the binder.

The amount of the light sensitizing agent can be changed in a wide range depending on the desired sensitivity and image density. In general, however, the light sensitizing agent is added in an amount of about 0.1 to about 100 parts by weight, preferably 5 to 60 parts by weight, per 100 parts by weight of Component (a).

The light-sensitive material of the present invention is image-wise exposed and heated at an appropirate temperature, whereby image-recording is achieved. One skilled in the art will appreciate, of course, that the image-wise exposure conditions can be varied greatly, and that optimum image-wise exposure conditions are determined using ordinary skill in the art. However, on an industrial scale, conveniently exposure is conducted using a xenon lamp, tungsten lamp, halogen lamp or the like and by conducting exposure for about 1 to about $10^2$ seconds with light of an intensity of about $10^3$ to about $10^5$ erg/cm$^2$ sec. That is, a latent image is generally produced by exposure, and then developed by heating. The image produced is generally a negative of the original image, and is black or red. It is believed that the image is provided by crystals or amorphous solids formed by aggregation of tellurium or selenium which is formed by decomposition of the complex thereof.

As electromagnetic waves for use in the exposure, ultraviolet or visible light from a xenon lamp, a mercury lamp, a tungusten lamp, a carbon arc, etc., are usually used, but in addition, X-rays, $\gamma$-rays, etc., of shorter wave length can be used for the image-formation. The kind of light source used depends on the spectral sensitivity of the light-sensitive material, that is, the kind of electromagnetic waves suitably used to form images.

Heating for development may be carried out either by bringing the material into close contact with a uniformly heated plate or by using heat rays from an infrared lamp. In addition, the high frequency heating can be used. Moreover, the material may be dipped in a heated inert liquid, for example, silicone oil or a liquid paraffin.

Heating is generally at between about 50° C and about 200° C, preferably between 80° C and 150° C. The heating time generally ranges between about 0.1 second and about 3 minutes, preferably between 5 seconds and 1 minute.

One advantage of the present invention is that a very stable black or red image is obtained at high sensitivity through the steps of exposing the material to form a latent image, and developing the latent image by heating. Another advantage of the present invention is that the addition of an appropriate amount of a sensitizing compound to the light-sensitive material increases its image density. A further advantage of the present invention is that the transparency of the light-sensitive material is not deteriorated since the amount of a sensitizing compound used is small as compared with that of Component (a).

The present invention will be now be illustrated in none detail by several examples of most preferred embodiments.

COMPARISON EXAMPLE 1

Into 3 ml of N,N-dimethylformamide were dissolved 50 mg of octadecylamine-tellurium tetrachloride (light-sensitive material), 20 mg of 9,10-phenanthrenequinone, and 300 mg of polyvinyl butyral (binder; average degree of polymerization = 1000). The resulting solution was coated on a 100 $\mu$ thick polyster film (support) by a rod coating machine, and dried at 50° C for 1 hour to form a 10 $\mu$ thick, transparent light-sensitive layer. This light-sensitive layer was brought into close contact with a wedge produced from a silver halide light-sensitive material, and exposed to light with a 1 KW xenon lamp at a distance of 30 cm for 1 minute. No visible change was detected in the light-sensitive layer. However, when this light-sensitive layer was brought into close contact with a hot plate heated at 150° C and kept in this state for 30 seconds, a continuous black negative image was obtained.

EXAMPLE 1

To the ingredients in Comparison Example 1 was added 3 mg of bismuth oxide ($Bi_2O_3$) to produce a light-sensitive dispersion, and subsequent procedures carried out in the same manner as in Comparison Example 1. The fog and exposure amount (log E) to provide a density of fog +0.1 were compared. The difference between the exposure amount (log E') to provide a density of fog +0.1 in Comparison Example and log E represents the degree of sensitization $\Delta S_{0.1}$ ($=\log E' - \lambda \log E$). $D_m$ indicates the maximum density with that of Comparison Example 1 as a standard.

| | $\Delta S_{0.1}$ | $D_m$ | Fog |
|---|---|---|---|
| Comparison Example | 0.5 | slightly increased | less |
| Example 1 | 0 | — | less |

EXAMPLE 2

In Example 1, the amount of bismuth oxide was changed to 5 mg, 10 mg, or 40 mg. Sensitivity, fog, and Dm were determined as in Example 1 and were as follows:

| $Bi_2O_3$ (mg) | Degree of Sensitization ($\Delta S_{0.1}$) | Dm | Fog | Remarks |
|---|---|---|---|---|
| 0 | 0 | — | less | Comparison Example 1 |
| 3 | +0.5 | slightly increased | less | Example 1 |
| 5 | +0.4 | increased | less | |
| 10 | +0.3 | increased | medium | |
| 40 | +0.2 | slightly decreased | less | |

Therefore, it is most suitable that the amount of $Bi_2O_3$ be 3 to 5 mg and the amount of Component (a) be 40 mg.

EXAMPLES 3*a* to 3*h*

To the ingredients of Comparison Example 1 were added the following materials to produce light-sensitive layers following the procedure of Example 1, and the properties of these layers were compared with those of the layer of Comparison Example 1 following the procedure Example 1.

| Run No. | Material | Amount | $\Delta S_{0.1}$ | Dm |
|---|---|---|---|---|
| 3a | $BiF_3$ | 2.8 | +0.3 | slightly increased |
| 3b | $BiCl_2$ | 3.4 | 0.3 | increased |
| 3c | $Sb_2O_3$ | 3.0 | 0.4 | slightly increased |
| 3d | $SbCl_3$ | 2.5 | 0.3 | remained unchanged |
| 3e | BiOCl | 3.0 | 0.2 | remained unchanged |
| 3f | $BiBr_3$ | 5.0 | desensitization | considerably decreased |
| | | | 0.6 desensitization | |
| 3g | $BiI_3$ | 7.6 | −0.2 | considerably decreased |
| 3h | $SbBr_3$ | 3.5 | −0.3 | |

3a to 3e: effective sensitizing inorganic compounds
3f to 3h: ineffective compounds, though similar to 3a to 3e.

EXAMPLE 4

Component (a) was changed as follows, and light-sensitive materials were produced in the same manner as in Example 1. It was confirmed that all of these image-forming materials were effective whe processed as in Example 1.

| Run No. | Image-forming Material | $\Delta S_{0.1}$ | Dm* |
|---|---|---|---|
| 4-a | Complex of $CF_3C_6H_4NH_2$ and $TeCl_4$ | +0.4 | increased |
| 4-b | Complex of $C_{14}H_{29}NH_2$ and $TeCl_4$ | +0.3 | slightly increased |
| 4-c | $(C_6H_5COCH_2)_2TeCl_2$ | +0.3 | remained unchanged |

*with Comparison Example 1 as the standard

EXAMPLE 5

In a solution of 5 g of polyvinyl formal (average degree of polymerization = 1000) and 50 g of dimethylformamide there was dispersed 300 mg of $TiO_2$ (antase type), $TiO_2$ (rutile type), or ZnO with a homomixer at 3,000 rpm.

To 5.0 g of each dispersion there were added 40 mg of a tellurium complex produced by reacting acetylaniline and tellurium tetrachloride and 40 mg of phenanthraquinone to produce a light-sensitive solution. This solution was coated on a 175 μ thick polyester film and dried at 60° C for 40 minutes to give a dry thickness of 7 μ. This layer was then exposed and developed as in Comparison Example 1.

| Run No. | Sensitizing Inorganic Compound | $\Delta S_{0.1}$ | Dm* | Fog |
|---|---|---|---|---|
| 5-a | No addition | 0 | — | less |
| 5-b | $TiO_2$ (anatase type) | 0.2 | unchanged | less |
| 5-c | $TiO_2$ (rutile type) | 0.2 | " | less |
| 5-d | ZnO | 0.4 | " | less |

*Same as Example 4

COMPARISON EXAMPLE 2

Into 3 ml of tetrahydrofuran were dissolved 50 mg of an ethylenediamine-selenium tetrachloride complex, 30 mg of catechol, and 250 mg of polyvinyl formal (average degree of polymerization = 100). On subjecting this solution to coating, exposure, and development as in Comparison Example 1, a red image of the negative type to the wedge image was obtained.

EXAMPLE 6

The procedure of Comparison Example 2 was repeated except that 5 mg of bismuth chloride ($BiCl_3$) was added.

A red image of the negative type was obtained which was of higher sensitivity, $\Delta S_{0.1}=0.5$, than that in Comparison Example 2.

COMPARISON EXAMPLE 3

Into 5 ml of tetrahydrofuran were dissolved 40 mg of a complex of $C_{14}H_{29}NH_2$ and $TeCl_4$, 20 mg of anthraquinone, and 500 mg of polyvinyl formal(binder; average degree of polymerization = 1000). The resulting solution was coated on a 180 μ thick undercoated polyester base using a rod coating machine and dried at 60° C for 30 minutes to form a transparent light-sensitive layer of a dry thickness of 7 μ. This layer was subjected to wedge exposure for 1 minute with a 1 KW xenon lamp at a distance of 10 cm, and then wound up on a roller heated at 140° C and kept in this state for 60 seconds.

Thus, a brown image of the negative type to the wedge image was obtained.

EXAMPLE 2

Following Comparison Example 3, 3 mg of $Bi_2O_3$ and 3 mg of $SbCl_3$ were further added to produce a light-sensitive layer. This layer was then processed in the same manner as in Comparison Example 3, and thus a brown image of the negative type was obtained which was of high sensitivity, $\Delta S_{0.1} = 0.4$, as compared with that in Comparison Example 3. Dm increased slightly, and fog remained unchanged.

While the invention has been described in detail and with reference to specific embodiments thereof, it will be apparent to one skilled in the art that various changes and modifications can be made therein without departing from the spirit and scope thereof.

What is claimed is:

1. A light-sensitive material comprising a layer (A) containing:

(a) at least one organic compound containing tellurium or and/or selenium selected from the group consisting of (i) an elemental compound in which tellurium or selenium is connected, directly or through a nitrogen or oxygen atom, to a carbom atom constituting a part of an organic group through a chemical bond, and which is capable of liberating tellurium or selenium on exposure and heating wherein said organic group is selected from the group consisting of (I) Ar-$COCH_2$-, (II) Ar-$CH_2$-and(III) R-$COCH_2$-, wherein Ar is an aryl group and R is an alkyl group or an aliphatic hydrocarbon group containing a carbonyl group; or (ii) a tellurium or selenium complex composed of tellurium halide or selenium halide and an organic base group; and (b) at least one sensitizing compound selected from the group consisting of the oxides, basic halides, halides, sulfates, nitrates, perchlorates, and organic acid salts of In (III), Sb (III), Ti (IV), Zn (II), Bi (III), Ge (IV), and Sn (IV); and further comprising in said layer (A) or in a layer (B) adjacent thereto, (c) at least one light-sensitizing agent selected from the group consisting of a quinone compound, an aryl ketone compound, a tetracyanoquinodimethane, a benzene or naphthalene substituted with a hydroxy group or an alkoxy group having 1 to 7 carbon atoms, an arylamine compound, a diazonium salt, a metal acetoacetonate or a salt of Fe, Co, Ni, Zr or Mo with a mono- or di-basic organic acid having 1 to 4 carbon atoms, ferricyanic acid or a halogen wherein component (b) is present in an amount of about 0.5 to about 50 parts by weight per 100 parts by weight of component (a) and component (c) is present in an amount of about 0.1 to about 100 parts by weight per 100 parts by weight of component (a).

2. The light-sensitive material of claim 1, wherein said layer A is carried on a support.

3. The light-sensitive material according to claim 2, wherein the organic compound containing tellurium or selenium is an elemental organic compound.

4. The light-sensitive material according to claim 1 wherein Ar is an unsubstituted aryl group.

5. The light-sensitive material according to claim 1 wherein the tellurium or selenium halide is represented by the formula:

$$MX_nY_m$$

wherein M is tellurium or selenium, X and Y are halogen, $n$ and $m$ are O or integers, and $n+m$ is 2 or 4 depending on the valency of M.

6. The light-sensitive material according to claim 2, wherein the sensitizing compound (b) is selected from the group consisting of $Sb_2O_3$, $Bi_2O_3$, BIOCl, SbOCl, SbOBr, $SbF_3$, $SbCl_3$, $BiF_3$, $BiCl_3$, $Bi(NO_3)_2$, ZnO, $TiO_2$, $In_2O_3$, and $InCl_3$.

7. The light-sensitive material according to claim 2, wherein the layer (A) is from about 0.5 to about 50 $\mu$ in dry thickness.

8. The light-sensitive material according to claim 1, wherein the organic group (I) is selected from the group consisting of

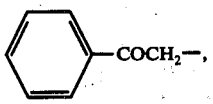

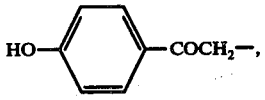

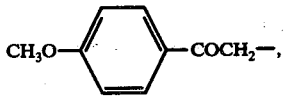

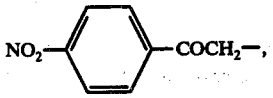

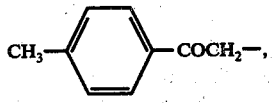

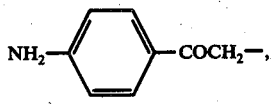

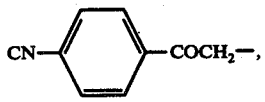

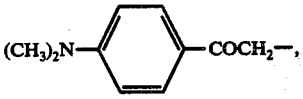

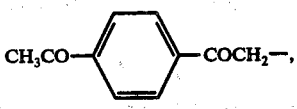

-continued

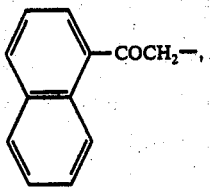

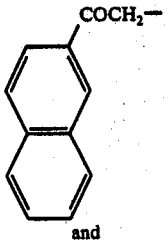

and

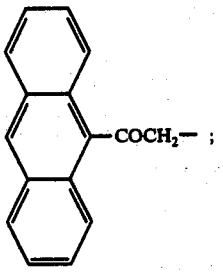

the organic group (II) is selected from the group consisting of

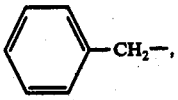

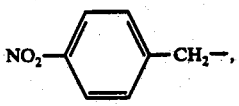

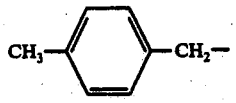

and

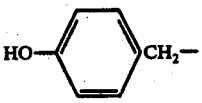

and the organic group (III) is selected from the group consisting of $CH_3COCH_2$—, $C_2H_5COCH_2$— and $CH_3COCH_2COCH_2$—.

9. The light-sensitive material according to claim 1 wherein said organic base group in said complex (ii) is selected from the group consisting of

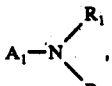

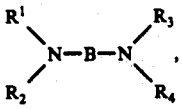

-continued

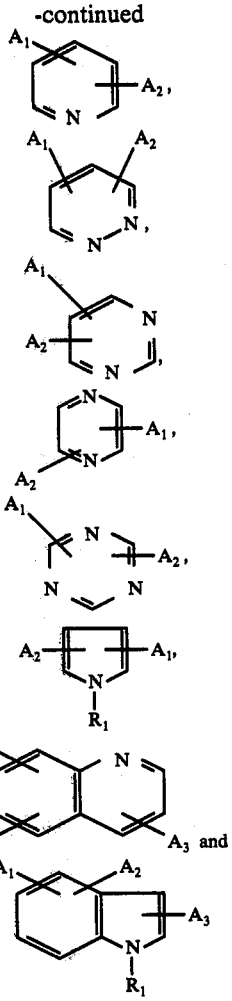

wherein $A_1$, $A_2$, $A_3$, $R_1$, $R_2$, $R_3$ and $R_4$ are hydrogen, alkyl or aryl and B is a divalent or higher aliphatic group or an arylene group.

10. The light-sensitive material according to claim 5, wherein said tellurium or selenium halide is selected from the group consisting of tellurium dichloride, tellurium dibromide, tellurium tetrafluoride, tellurium tetrachloride, tellurium tetrabromide, tellurium tetraiodide, selenium tetrachloride, selenium tetrabromide, and selenium tetraiodide.

11. The light-sensitive material according to claim 1, wherein said organic base group in the tellurium or selenium compound (ii) is selected from the group consisting of ethylamine, propylamine, butylamine, tert-butylamine, pentylamine, isopentylamine, hexylamine, heptanylamine, octylamine, nonylamine decylamine, tert-decylamine, undecylamine, dodecylamine, tetradecylamine, pentadecylamine, octadecylamine, nonadecylamine, eicosylamine, docosylamine, tricosylamine, tetracosylamine, pentacosylamine, ethoxyethylamine, ethoxypropylamine, ethoxybutylamine, ethoxypentylamine, ethoxyhexylamine, methoxyhexylamine, methoxyoctylamine, methoxyeicosylamine, methoxytricosylamine, benzylamine, triphenylmethylamine, phenethylamine, vanillylamine, veratrylamine, poly(p-aminostyene), N-methylethylamine, N-methylpropylamine, N-methylbutylamine, N-methyl-tert-butylamine, N-methylheptanylamine, N-methyloctylamine, N-methylnonylamine, N-methyl-tert-decylamine, N-methyloctadecylamine, N-methyldecylamine, N-methylethoxybutylamine, N-methylmethoxyhexylamine, N-methylmethoxyeicosylamine, N-methylbenzylamine, N-methyltrimethyamine, N-methylphenethylamine, N-methylvanillylamine, N-methylveratrylamine, N-ethylbutylamine, N-ethylpentylamine, N-ethyldecylamine, N-ethyldodecylamine, N-ethyloctaadecylamine, N-ethyleicosylamine, N-ethyldocosylamine, N-ethyltetracosylamine, N-ethylpentacosylamine, N-ethylethoxyhexylamine, N-ethylmethoxyhexylamine, N-ethylbenzylamine, N,N-dimethylethylamine, N,N-dimethylpropylamine, N,N-dimethylbutylamine, N,N-dimethyl-tert-butylamine, N,N-dimethylheptanylamine, N,N-dimethyloctylamine, N,N-dimethylnonylamine, N,N-dimethylmethoxyhexylamine, N,N-dimethylmethoxyeicosylamine, N,N-dimethylphenethylamine, N,N-dimethylvanillyl, N,N-dimethylveratrylamine, N,N-diethylvanillylamine, N,N-diethylpropylamine, N,N-diethylbenzylamine, N,N-dimethylbenzylamine, aniline, nitroaniline, trifluoromethylaniline, toluidine, ethylaniline, chloroaniline, bromoaniline, methylaminobenzoate, butylaniline, phenylaniline, naphthylaniline, dinitroaniline, naphthylamine, methoxyaniline, acetylaniline, N-methylaniline, N-ethylaniline, N,N-dimethylaniline, N,N-diethylaniline, N-methylnitroaniline, N,N-dimethylnitroaniline, N,N-diethylnitroaniline, N,N-dimethylnitroaniline, N,N-dimethyltoluidine, N,N-dimethylacetylaniline, N,N-dimethylmethoxyaniline, N,N-dimethylnaphthylamine, N,N-dimethyltrifluoroaniline, p-n-dodecylaniline, ethylenediamine, propylenediamine, butylenediamine, ethylethylenediamine, methyltrimethyldiamine, propenyldiamine, hexadienyleneamine, phenyltrimethylenediamine, diaminodiphenylmethane, diaminobenzophenonenaphtylenediamine, benzidine, oxydiphenylenediamine, phenylenediamine, methylphenylenediamine, ethylphenylenediamine, N,N,N',N'-tetramethylphenylenediamine, N,N,N',N'-tetramethyloxydiphenylenediamine, tetrabase, N,N,N',N'-tetramethyldiaminobenzophenone, N,N,N',N'-tetramethylbenzidine, N,N,N',N'-tetramethylethylenediamine, N,N,N',N'-tetramethylhexamethylenediamine, N,N,N',N'-tetramethylpropanediamine, N,N,N',N'-tetramethyltrimethylenediamine, pyridinediamine, dimethylpyridine, pyridine carbinol, pyridine ethanol, pyridine-carboxylic acidmethyl ester, pyrazine, methylpyrazine, ethylpyrazine, methyl pyrazinecarboxylate, trimethylpyrazine, pyrimidine, 5-methylpyrimidine, methoxypyrimidine, 5-hydroxypyrimidine, methylpyridazine, methoxypyridazine, phenylpyridazine, ethylpyridazine, triazine, pyrrole, N-methylpyrrole, acetylpyrrole, dinitropyrrole, tetramethylpyrrole, dipyrrylmethane, N-methylacetylpyrrole, indole β-aminoethylindole, methylindole, methoxyindole, N-methylindole, N-methyl-methylindole, dimethylindole, quinoline, quinoline methanol, chloroquinoline methoxyquinoline, nitroquinoline, and aminoquinoline.

12. The light-sensitive material according to claim 6, wherein said sensitizing compound (b) is selected from the group consisting of $Bi_2O_3$, BiOCl, $BiF_3$, $BICl_3$, $Sb_2O_3$, $SbF_3$, $SbCl_3$ and $Bi(NO_3)_2$.

13. The light-sensitive material according to claim 1, wherein in said light-sensitizing agent (c), said quinone compound is an o- or p- benzoquinone, an o- or p-naphthoquinone, a phenanthroquinone or an anthraquinone;

said aryl ketone compound is a phenyl, naphthyl, anthryl or phenanthryl group substituted with at least one acyl group having 1 to 4 carbon atoms;

said aryl amine is an amine substituted with 1 or more phenyl or naphthyl groups;

said diazonium salt is represented by the formula $ArN_2^+X^-$ wherein Ar is a phenyl group or a naphthyl group and $X^-$ is a halogen ion, $BF_4^-$, or $SO_3^{2-}$; and said metal acetylacetonate is represented by the formula M (AA)x wherein M is Co, Ni, Cr, Fe, Zr, Mo or an oxide thereof, AA is acetyl acetonate, dibenzylmethane or acetylbenzylmethane and *x* has the valency of M.

14. The light-sensitive material according to claim 1, wherein said light-sensitizing agent (c) is selected from the group consisting of 1-nitroanthraquinone, 2-tert-butyl-anthraquinone, chloranil, benzophenone, 3-methylnaphthoquinone, tetrabromoquinone, 9,10-phenanthrenequinone, 2-nitrophenanthrenequinone, 2,5-dinitrophenanthrenequinone, acetophenone, fluorenone, benzil, p-acetylbenzophenone, Michler's ketone, p-diacetylbenzene, ω-tribromo-acetophenone, 2,4,7-trinitrofluorenone, β-naphthoquinone, p-benzoquinone, α-naphthoquinone, resorcinol, anisole, p-methoxyphenol, 4-methoxy-α-naphthol, diphenylamine, triphenylamine, 4-hydroxydiphenylamine, 4-ethoxybenzene diazonium chloride, 2,5-dimethoxybenzene diazonium chloride, 4-N,N-dimethylaminobenzene diazonium chloride, 1,6diethoxy-N,N-diethylaminobenzene diazonium chloride, 4-morpholinobenzene diazonium chloride, zirconium acetyl acetonate, molybdenumoxy-acetylacetonate, $FeCl_2$, $FeCl_3$, $FeBr_2$, $FeBr_3$, ferricyanides, cobaltous acetate and iron oxalate.

15. The light-sensitive material according to claim 1, wherein component (b) is present in an amount of 2 to 20 parts by weight per 100 parts by weight of component (a) and component (c) is present in an amount of 5 to 60 parts by weight per 100 parts by weight of component (a).

* * * * *